US008584857B2

(12) United States Patent
Ozawa et al.

(10) Patent No.: US 8,584,857 B2
(45) Date of Patent: Nov. 19, 2013

(54) CARD PACKAGE

(75) Inventors: Koji Ozawa, Ota (JP); Yoshiei Harada, Tokyo (JP); Koji Uno, Tokyo (JP); Tetsuo Oida, Tokyo (JP)

(73) Assignee: Mitsubishi Shoji Packaging Corporation, Tokyo (JP)

( * ) Notice: Subject to any disclaimer, the term of this patent is extended or adjusted under 35 U.S.C. 154(b) by 216 days.

(21) Appl. No.: 13/256,282

(22) PCT Filed: Mar. 13, 2009

(86) PCT No.: PCT/JP2009/054908

§ 371 (c)(1),
(2), (4) Date: Oct. 5, 2011

(87) PCT Pub. No.: WO2010/103658

PCT Pub. Date: Sep. 16, 2010

(65) Prior Publication Data

US 2012/0091027 A1 Apr. 19, 2012

(51) Int. Cl.
*B65D 83/04* (2006.01)

(52) U.S. Cl.
USPC ..... 206/531

(58) Field of Classification Search
USPC ..... 206/528, 529, 531, 532, 534, 536, 538; 221/25
See application file for complete search history.

(56) References Cited

U.S. PATENT DOCUMENTS

| | | | | |
|---|---|---|---|---|
| 7,243,797 | B2 * | 7/2007 | Donegan | 206/531 |
| 2004/0129717 | A1 * | 7/2004 | Gauthier et al. | 221/25 |
| 2004/0188313 | A1 * | 9/2004 | Tedham | 206/531 |
| 2008/0017542 | A1 | 1/2008 | Le et al. | |
| 2010/0230320 | A1 * | 9/2010 | Caron et al. | 206/531 |
| 2010/0230321 | A1 * | 9/2010 | Grosskopf | 206/531 |

FOREIGN PATENT DOCUMENTS

| | | | |
|---|---|---|---|
| JP | 3045701 | U | 11/1997 |
| JP | 3054841 | U | 9/1998 |
| JP | 2000-168832 | A | 6/2000 |
| JP | 2001-70404 | A | 3/2001 |
| JP | 2003-321075 | A | 11/2003 |
| JP | 2007-509004 | A | 4/2007 |
| WO | WO 01/00135 | A1 | 1/2001 |

OTHER PUBLICATIONS

International Preliminary Report on Patentability (IPRP) dated Oct. 18, 2011 (and English translation thereof) issued in counterpart International Application No. PCT/JP2009/054908.
International Search Report dated Jun. 2, 2009 in counterpart International Application No. PCT/JP2009/054908.
Korean Office Action dated Mar. 28, 2013 (and English translation thereof) in counterpart Korean Application No. 10-2011-7023851.

* cited by examiner

*Primary Examiner* — Jacob K Ackun
(74) *Attorney, Agent, or Firm* — Holtz, Holtz, Goodman & Chick, PC

(57) ABSTRACT

Provided is a mount sheet (12) affixed to a PTP sheet (50) which accommodates a product, such as a tablet (53) and is formed by punching out a blank sheet. The mount sheet (12) includes a first surface (14) to be placed on a surface of the PTP sheet (50) from which the projecting portion 52*a* is projecting, multiple holes (16) formed in the first surface 14 and in which the projecting portion (52*a*) is placed, and a second surface (24) which continues from the first surface (14) via a folding line (26) and is to be folded on the opposite surface of the PTP sheet (50). The second surface (24) has a rupturable line (28) formed at a position to face the projecting portion 52*a* when folded and placed on the PTP sheet (50). An ejector tool (56) is provided which is affixed to the third surface 36 on a surface to be folded over the first surface (14) and has a pressing projection (60) projecting toward the PTP sheet (50).

12 Claims, 5 Drawing Sheets

(a)

(b)

(a)

(b)

CARD PACKAGE

This application is a U.S. National Phase Application under 35 USC 371 of International Application PCT/JP2009/054908 filed Mar. 13, 2009.

TECHNICAL FIELD

The present invention relates to a card package in which a mount sheet is affixed to a PTP sheet for packaging.

BACKGROUND ART

An example of a related art technique of packaging tablets is a PTP sheet. The PTP sheet includes a molded plastic product made of synthetic resin. The molded plastic product includes, in an integrated manner, a projection provided with a space in which a tablet is accommodated and a flat part formed at a peripheral edge of the projection. The PTP sheet includes a rupturable sheet, such as aluminum foil, affixed to the PTP sheet at a side opposite to the side on which the projection is formed; the rupturable sheet closes the space in the projection and seals a tablet. The tablet may be ejected by the methods of pushing with a finger or peeling the sheet. The method of pushing with a finger has a problem that it requires a fine operation and enough strength to push with a finger, and it is difficult to push with enough strength. Similarly, the method of peeling the sheet requires very fine operation.

Recently, tablets and capsules which are small in size have been developed from the viewpoint of the ease of taking. Along with this, the projection of the PTP sheet decreases in size and, at the same time, increases in thickness; thus, greater strength has been required to push the projection. For this reason, not only weak women and elderly persons but ordinary men sometimes feel difficulty in taking tablets out of the projection; taking tablets is even more difficult for persons who have weak finger strength, such as elderly persons and patients of rheumatism. Such difficulty in taking tablets out is a cause of discouraging proper administration for elderly persons and patients with impaired mind and body function; thus compliance of the usage of medicines becomes low. With the development of the aging society, there is a demand for the tablets which are easy in taking by elderly persons as well as for packages useful for elderly persons. There is also a demand for packages useful not only for elderly persons but weak persons such as women, persons who have weak finger strength due to their sickness and even ordinary persons.

A blister package disclosed in Patent Document 1 has been a technique to easily take tablets out of a PTP sheet. The blister package has circumference cut portions around projections on a flat portion. When opening, the flat portion is folded at the circumference cut portions and divided into separate pieces; then a sheet affixed to the flat portion is peeled to open the projection.

A tablet ejector device for taking tablet out of the PTP sheet is also proposed. For example, the tablet ejector device disclosed in Patent Document 2 and the tablet remover disclosed in Patent Document 3 have two cylindrical main bodies which are axially connected at one ends and open and close at a predetermined angle, and have a spring to open at definite angles. At the free end of one of the main bodies, a projection projecting toward the other main body is provided; and a through hole is formed in the other of the main bodies at a position at which the projection contacts. When taking a tablet out of the PTP sheet, a projecting portion of the PTP sheet in which the tablet is accommodated is moved to a position corresponding to the through hole, and the pair of main bodies is closed. Then, a projection pushes the projecting portion, the sheet of the PTP sheet is ruptured and the tablet, having passed through the through hole, is ejected on the opposite side.

As an alternative, a mount sheet made of, for example, paper, is affixed to the PTP sheet; the mount sheet has spaces in which dates are filled to remind people to take their tablets without fail and in which information about the tablet or instructions for use are printed. Such medicines are used in the packages of generic drug which can be purchased at drugstores, medicines for medical doctors which require prescription, and medicines for clinical trials whose compliance is very important or the like. For example, the card package disclosed in Patent Document 4 has a PTP sheet disposed and sealed between a pair of cardboards and a mount sheet which is provided with a hole in which a projecting portion of the PTP sheet is placed.

Patent Document 1: JP-U-5-665

Patent Document 2: JP-A-2002-143274

Patent Document 3: The utility model registration No. 3054841

Patent Document 4: JP-A-10-59415

SUMMARY OF THE INVENTION

Problems to be Solved by the Invention

In the package of Patent Document 1, a sheet should be peeled from a flat portion of a PTP sheet to open the package. The peeling requires enough strength and thus it is difficult for the weak elderly persons and handicapped persons to take tablets out of the package. The ejector devices of Patent Document 2 and Patent Documents 3 achieve easy taking out of tablets, but these devices are not useful for those who have difficulty in laying stress on their finger.

The package of Patent Document 4 has spaces on a mount sheet in which dates are filled to remind people to take their tablets without fail and in which information about the tablet or instructions for use are printed. However, easy ejecting of the tablets is not considered in this package.

The present invention is made in view of the problems of the above-described background art, and an object thereof is to provide a card package from which medicines, such as tablets, can be easily ejected and on which information about the tablet, date for the administration management or the like, can be printed.

Means for Solving the Problem

The present invention is a card package, including: a PTP sheet and a mount sheet, the PTP sheet including a molded product which has multiple projecting portions accommodating products therein and a flat portion provided in the circumference of the projecting portions, and a rupturable sheet which is affixed to the molded product to seal openings of the projecting portions, the PTP sheet being affixed to the mount sheet, wherein: the mount sheet includes: a first surface to be placed on the PTP sheet on a surface on which the projecting portions are projecting; multiple holes formed in the first surface and in which the projecting portions are placed; a second surface to be placed on an opposite surface of the PTP sheet; multiple rupturable portions formed in the second surface at positions corresponding to each of the projections when the second surface is folded and placed on the PTP sheet; a fixing means which holds the PTP sheet between the first surface and the second surface; and an ejector tool formed on the first surface and has a pressing portion which faces the projecting portions of the PTP sheet.

The pressing portion is a projection projecting toward the projecting portions. The rupturable line formed in the second surface along circles in the circumference of the projecting portions of the PTP sheet and the rupturable line is by cut portions and uncut portions which are arranged alternately and the uncut portions are ruptured at predetermined positions.

The projecting portions of the PTP sheet are arranged along a circumference of a virtual circle; one end of the ejector tool is rotatably locked by a holding through hole formed in the first surface; and the other end of the ejector tool is formed to correspond to the circumference of the virtual circle along which the projecting portions of the PTP sheet are arranged.

A positioning projection is formed in an intermediate portion of the main body of the ejector tool; when the ejector tool is moved to a predetermined position, the positioning projection is placed in and locked by the positioning through hole formed in the first surface and the pressing portion of the ejector tool faces the projecting portions of the PTP sheet in that state.

A card package, including: a PTP sheet and a mount sheet, the PTP sheet including a molded product which has multiple projecting portions accommodating products therein and a flat portion provided in the circumference of the projecting portions, and a rupturable sheet which is affixed to the molded product to seal openings of the projecting portions, the PTP sheet being affixed to the mount sheet, wherein: the mount sheet includes: a first surface to be placed on the PTP sheet on a surface on which the projecting portions are projecting; multiple holes formed in the first surface and in which the projecting portions are placed; a second surface to be placed on an opposite surface of the PTP sheet; multiple rupturable portions formed in the second surface at positions corresponding to each of the projections when the second surface is folded and placed on the PTP sheet; a fixing means which holds the PTP sheet between the first surface and the second surface; and a third surface which continues from the first surface or the second surface via a folding line and is to be placed on the PTP sheet on a surface at which the projecting portions are projecting; an ejector tool affixed to the third surface on a surface to be placed on the first surface, and having a pressing portion which faces the projecting portions of the PTP sheet.

The pressing portion is a projection projecting toward the projecting portions. The rupturable line formed in the second surface along circles in the circumference of the projecting portions of the PTP sheet and the rupturable line is by cut portions and uncut portions which are arranged alternately and the uncut portions are ruptured at predetermined positions.

The third surface is folded to face the first surface; the third surface is provided with a holding portion which holds the ejector tool to be movable; and the ejector tool is provided with a locking portion which is locked by the holding portion to be movable.

The third surface is provided with a positioning through hole in which a part of the ejector tool is placed and positioned; and the ejector tool is provided with a positioning projection placed in the positioning through hole.

The projecting portions of the PTP sheet are arranged along a circumference of a virtual circle; the third surface is provided with a holding through hole which holds the ejector tool to be rotatable; the ejector tool is provided with a locking projection which is locked by the holding through hole to be rotatable; the locking projection of the ejector tool is locked by the holding through hole to be rotatable; and the pressing portion of the ejector tool is formed to be located on the circumference of the virtual circle along which the projecting portions of the PTP sheet are arranged.

The positioning projection is formed in an intermediate portion of the main body of the ejector tool; when the ejector tool is rotated by a predetermined angle, the positioning projection is placed in and locked by the positioning through hole formed in the third surface; and the pressing portion of the ejector tool faces the projecting portions of the PTP sheet in that state.

Effect of the Invention

With the card package of the present invention, even a person with small force can easily take out a tablet or the like accommodated in a PTP sheet. If the product is a medicine, such as a tablet, the compliance regarding the medicine with a person can be enhanced by printing details of information about the medicine, date frequency with which the medicine is taken for administration management and explicitly specifying records of frequency with which the medicine is taken. Since a small ejector tool is provided integrally, the card package is compact and carriable; thus the product, such as a tablet, can be ejected in an easy operation at any places.

BRIEF DESCRIPTION OF THE DRAWINGS

FIG. 1(*b*) is a perspective view illustrated in a state in which the mount sheet is folded.

FIG. 2(*b*) is a fragmentary longitudinal sectional view illustrating a state in which the mount sheet is folded and a tablet is being pushed out.

FIG. 7(*b*) is a perspective view illustrated in a state in which the mount sheet is folded.

DESCRIPTION OF EMBODIMENTS

Hereinafter, an embodiment of the present invention will be described with reference to the drawings. FIG. 1 to FIG. 6 illustrate an embodiment of the present invention. A card package 10 of the present invention is provided with a mount sheet 12 which is formed by punching out a blank sheet, such as a sheet of paper. The thickness of the mount sheet 12 is preferably 200 micrometers to 800 micrometers, but the mount sheet 12 of other thickness may be used depending on the purpose. Instead of paper, synthetic resin, synthetic paper and metal may be used depending on the usage and type of the medicine which is a product.

Figure 3:
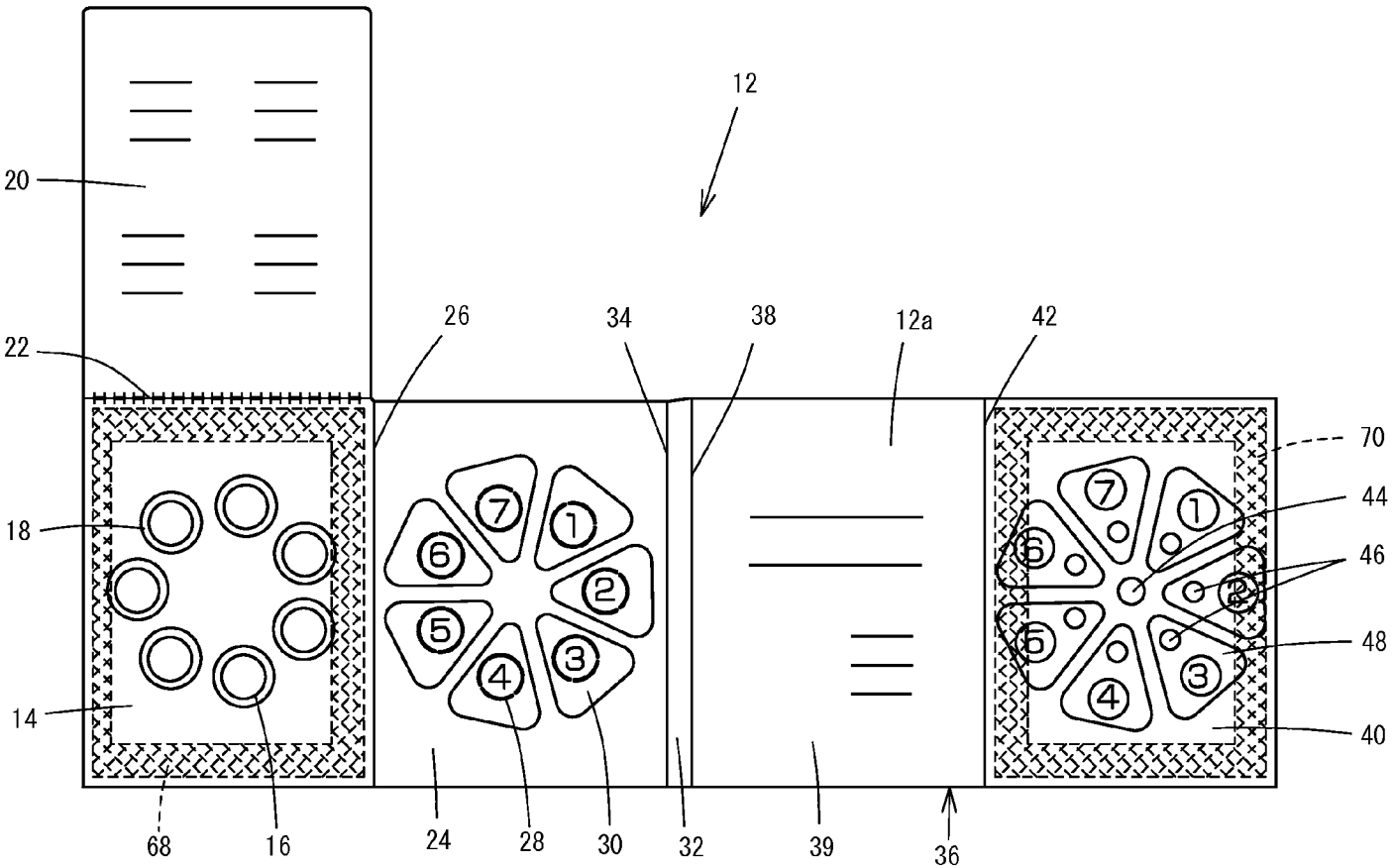
FIG. 3 is a developed view of the mount sheet of the card package of the present embodiment.

FIG. 3 is a developed view of the mount sheet 12 seen from the side of a front surface 12*a*. The mount sheet 12 is provided with a rectangular first surface 14. In the first surface 14, holes 16 are formed to receive projecting portions 52*a* of a PTP sheet 50 which will be described below. Seven holes 16 are arranged at equal intervals on the circumference of a virtual circle about the center of the substantially center of the first surface 14. Each of the holes 16 is circular in shape. Annular printed portions 18, defined by ink of different color each corresponding to each of the holes 16, are provided around the holes 16.

A folding-back piece 20 which is substantially the same in shape as the first surface 14 is provided at one longitudinal end of the first surface 14. A fold line 22 separates the folding-back piece 20 and the first surface 14. Details of the medicine and an administration method are printed on the folding-back piece 20. A rupturable line is formed over the folding line 22 to provide easy folding.

A second surface 24 which is substantially the same in shape as the first surface 14 is provided at a side edge which intersects the folding line 22 of the first surface 14. A folding line 26 separates the second surface 24 and the first surface 14. Rupturable lines 28 are formed on the second surface 24 which form seven rupturable portions at positions corresponding to the holes 16 when the second surface 24 is folded at the folding line 26 and put over the first surface 14. The rupturable line 28 is formed in the round shape along the circumference of each of the holes 16. The rupturable line 28 is formed by cut portions and uncut portions which are arranged alternately. Numbers from "1" to "7" are printed clockwise in this order inside the rupturable lines 28. Printed portions 30 are provided around the rupturable line 28 with ink of different color for each rupturable line 28. Each of the printed portions 30 is formed as an isosceles triangle with two sides of equal length extending in a radial direction from the center of the second surface 24. The color of each printed portion 30 is in agreement with the color of the printed portion 18 of the first surface 14 when the second surface 24 is put over the first surface 14.

A gore 32 is provided at a side edge of the second surface 24 on the side opposite to the folding line 26. A folding line 34 separates the gore 32 and the second surface 24. The gore 32 is elongated rectangular in shape extending from the folding line 34 to the side at the predetermined width, which width is substantially the same as the height of the projecting portions 52*a*. A third surface 36 is provided at a side edge of the gore 32 on the side opposite to the folding line 34. A folding line 38 separates the gore 32 and the third surface 36. The third surface 36 is separated by the folding line 38 and is constituted by a front surface 39 and an ejector tool holder 40. The ejector tool holder 40 is separated from the front surface 39 by a folding line 42 and is the same in shape as the front surface 39. The front surface 39 is substantially the same in shape as the first surface 14 and the second surface 24. The front surface 39 is an outer surface of the card package 10 in an assembled state thereof. The medicine's name and the manufacturer's name or the like are printed on the front surface 39.

The ejector tool holder 40 on the third surface 36 is substantially the same in shape as the front surface 39. A holding through hole 44 locks an ejector tool 56 which will be described below is formed at the center of the ejector tool holder 40. Seven positioning through holes 46 are arranged at equal intervals on the circumference of a virtual circle about the holding through hole 44. The radius of the virtual circle on which the positioning through holes 46 are located is smaller than the radius of the virtual circle on which the rupturable line 28 is arranged in series on the second surface 24. Each positioning through hole 46 on the circumference of a virtual circle is located on each of seven radial lines extending between the center of each rupturable line 28 on the second surface 24 and the virtual circle described above in a state in which folded the mount sheet 12 is folded. Each positioning through hole 46 is round in shape which is smaller than each hole 16.

Printed portions 48 are provided around the positioning through holes 46 with ink of different color for each positioning through hole 46. Each of the printed portions 48 is formed as an isosceles triangle with two sides of equal length extending in a radial direction from the center of the holding through hole 44. The color of each printed portion 48 and the color of each printed portion 30 of the second surface 24 at the corresponding position are the same. Numbers from "1" to "7" are printed clockwise in this order inside the printed portions 48 at positions further separated from the holding through hole 44 than the positioning through holes 46. The positions of the numbers correspond to the positions of the numbers printed on each rupturable line 28 on the second surface 24.

Figure 1:
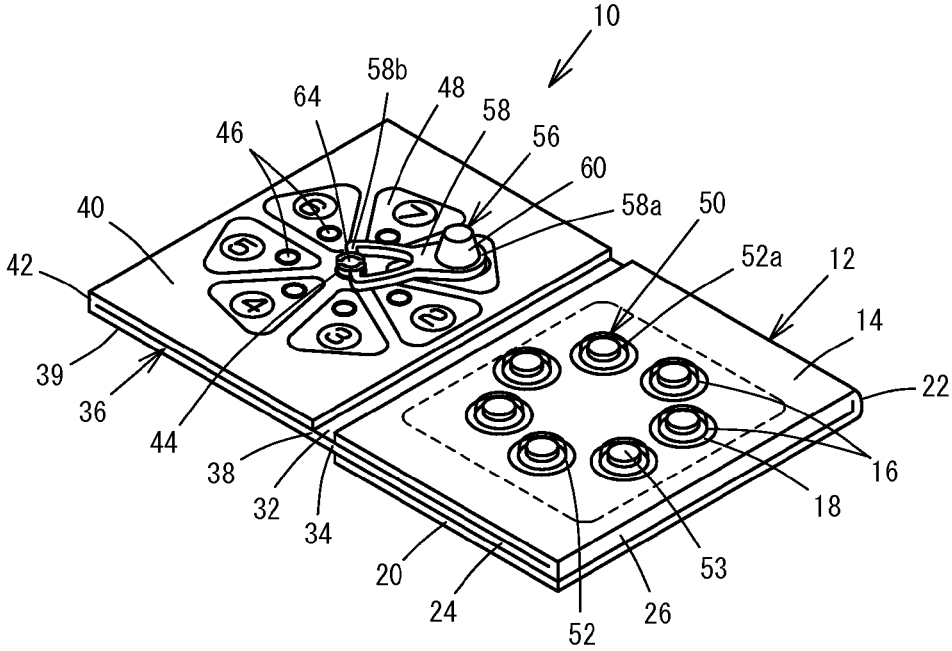
FIG. 1(*a*) is a perspective view of a card package of an embodiment of the present invention illustrating a state in which a mount sheet is opened.
Figure 1:
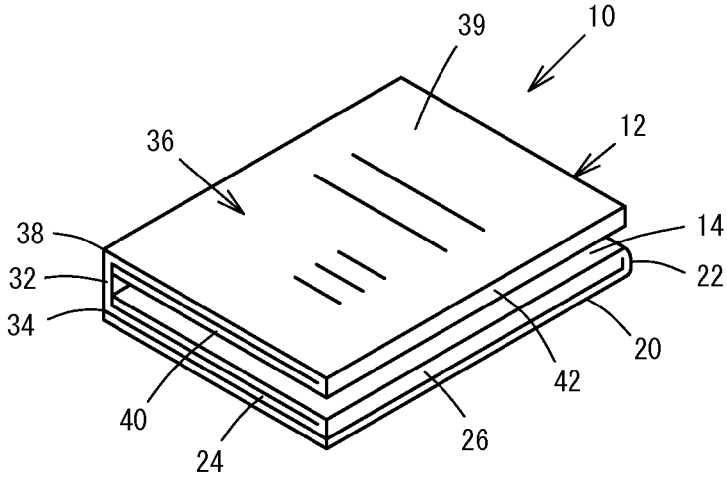
Figure 4:
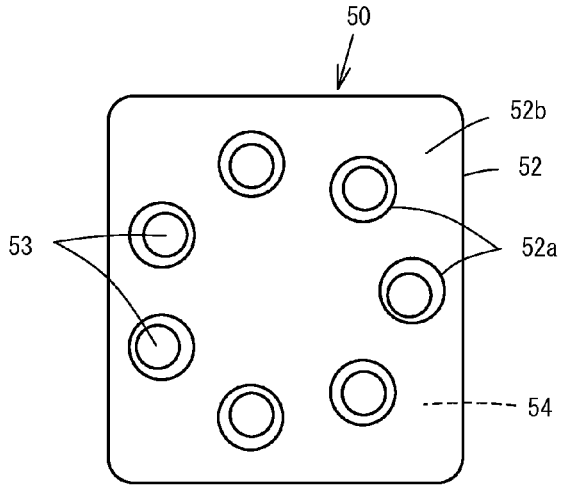
FIG. 4 is a front view of a PTP sheet of the card package of the present embodiment.

Next, the PTP sheet 50 which is placed in the mount sheet 12 will be described. A molded plastic product 52 is provided on the PTP sheet 50. As illustrated in FIG. 1 and FIG. 4, the molded plastic product 52 includes projecting portions 52*a* each accommodating a tablet 53 therein and a flat portion 52*b* provided at peripheral edges of the projecting portions 52*a*. Materials of the molded plastic product 52 are barrier packaging media or the like, such as PP, PVC, PET, PVC/PVDC, PVC/polychlorotrifluoroethylene, aluminum and aluminum laminate material.

A rupturable sheet 54, such as thin aluminum foil and a resin sheet, is attached to the flat portion 52*b* on the surface opposite to the surface on which projecting portions 52*a* project. The rupturable sheet 54 closes openings of the projecting portions 52*a* to tightly seal the tablets. Seven projecting portions 52*a* are provided on a PTP sheet 50 at equal intervals on the circumference of a virtual circle about the center of the molded plastic product 52. The PTP sheet 50 is rectangular in shape which is smaller than the first surface 14 of the mount sheet 12. The projecting portions 52*a* are provided at positions corresponding to the holes 16 and are sized to be placed in the holes 16.

Figure 5:
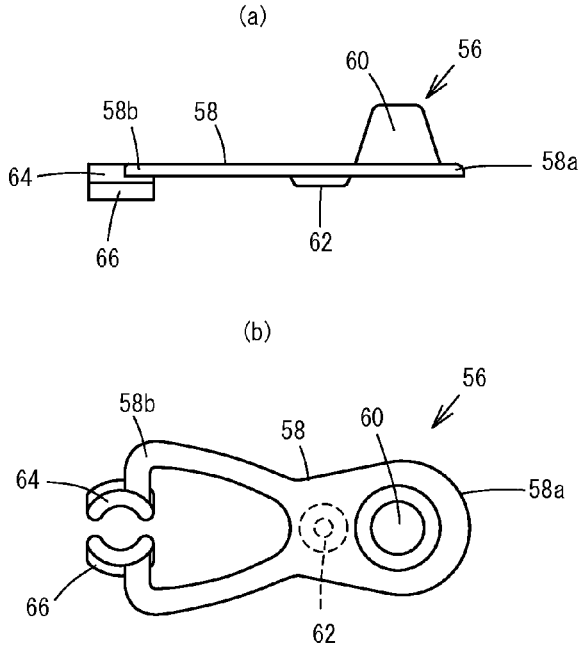
FIG. 5(*a*) is a front view and FIG. 5(*b*) is a plan view of an ejector tool of the card package of the present embodiment.

Next, the ejector tool 56 attached to the ejector tool holder 40 of the mount sheet 12 will be described. The ejector tool 56 is integrally molded from synthetic resin, such as PP. As illustrated in FIG. 5, the ejector tool 56 includes a main body 58 which is an elongated sheet material extending in one direction. One longitudinal end 58*a* of the main body 58 is a curved line expanding outward at which a conical-shaped pressing projection 60 projecting from one side of the main body 58 is provided. It is preferable to achieve easy ejection that the diameter of the tip of the pressing projection 60 is smaller than the diameter of the projecting portion 52*a* of the molded plastic product 52. A positioning projection 62 projecting on the side opposite to the side the pressing projection 60 projects is provided at a position slightly separated from the end 58*a* of the main body 58. The projecting amount of the positioning projection 62 is smaller than that of the pressing projection 60.

An end 58*b* of the main body 58 on the side opposite to the end 58*a* is divided into two and the divided portions are curved outward and are away from each other. A locking projection 64 is formed integrally at a tip of the end 58*b*. The locking projection 64 is constituted by two parts which are shaped as a cylinder divided into two. The pair of parts faces each other to form substantially cylindrical shape and placed in a surface of the main body 58 in a direction at a right angle to a surface of the main body 58 and extend on the side opposite to the pressing projection 60. On an outer peripheral surface of the locking projection 64, a flange 66 which is separated from and is parallel to the main body 58 is provided to project outward. The distance between the locking projection 64 and the positioning projection 62 of the ejector tool 56 is substantially equal to the length from the holding through hole 44 to the positioning through hole 46 of the ejector tool holder 40. The distance between the locking projection 64 and the pressing projection 60 substantially equal to the length from the holding through hole 44 of the ejector tool holder 40 to the hole 16 of first surface 14 when the mount sheet 12 is folded with the card package 10 being assembled.

Next, method of assembling the card package 10 of the present embodiment will be described. Here, FIG. 3 is a diagram seen from the front surface 12*a* of the mount sheet 12 of the card package 10. A way of folding with the front surface 12*a* of the mount sheet 12 projecting is referred to as mounting folding, a way of folding with a rear surface 12*b* projecting is referred to as valley folding.

Figure 6:
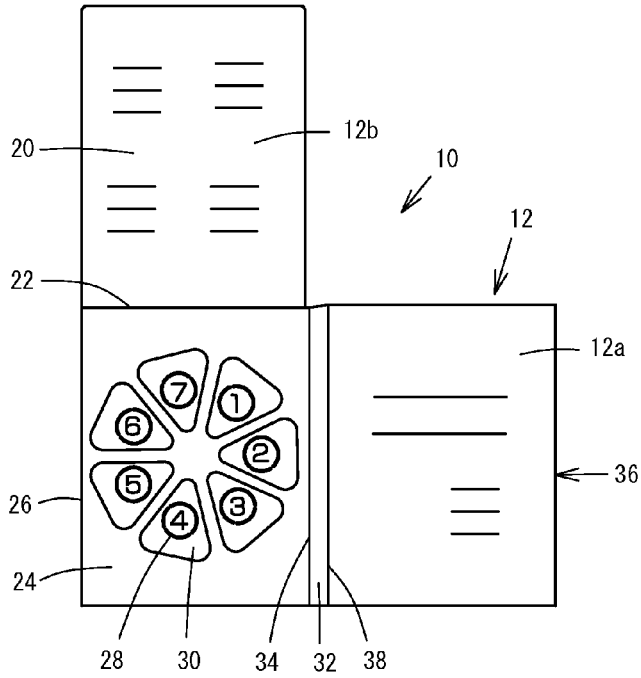
FIG. 6 is a front view illustrating an assembly process of the card package of the present embodiment.

First, an adhesive 68 is applied around the peripheral edge of the rear surface 12*b* of the first surface 14, and the PTP sheet 50 is affixed thereto. At this time, the molded plastic product 52 of the PTP sheet 50 is placed over the rear surface 12*b* to be in contact with the first surface 14, the projecting portions 52*a* are placed in the holes 16 and are made to project on the side of the front surface 12*a*. Next, the second surface 24 is mounted-folded on the folding line 26 and the rear surface 12*b* of the second surface 24 is made to adhere to the rear surface 12*b* of the first surface 14 with the adhesive 68 which is a fixing means. Since the adhesive 68 is applied in a range wider than the molded plastic product 52 of the PTP sheet 50, the adhesive 68 protrudes from the circumference of the PTP sheet 50 to make the first surface 14 reliably adhere to the second surface 24. Then, adhesive 70 is applied around the peripheral edge of the rear surface 12*b* of the ejector tool holder 40 and the mountain-folding is made on the folding line 42. The rear surface 12*b* of the third surface 36 is affixed to the rear surface 12*b* of the ejector tool holder 40 with the adhesive 70. Thus, the state illustrated in FIG. 6 is achieved.

Then, the folding-back piece 20 is mountain-folded on the folding line 22 and is placed on the second surface 24, the ejector tool 56 is set to the ejector tool holder 40, and thus achieves the state illustrates in FIG. 1(*a*). At this time, the locking projection 64 of the ejector tool 56 is placed in the holding through hole 44 of the ejector tool holder 40 and the flange 66 is in contact with the rear surface 12*b* of the peripheral edge of the holding through hole 44 to prevent the removal of the locking projection 64. Since the end 58*b* is divided into two, when elastically deformed to come close to each other, the diameter of the locking projection 64 becomes small and thus the flange 66 can be placed in the holding through hole 44. Then the folding lines 34 and 38 are mountain-folded at 90 degrees to fold the mount sheet 12 into two halves about the gore 32 and thus the state illustrated in FIG. 1(*b*) is achieved. In this manner, a product is provided. At this time, the third surface 36 is located on the outer surface on which the printing of the medicine's name and the manufacturer's name is visually recognized.

The mount sheet 12 may be put in a bag or sealed with a tape such that the double-folded mount sheet 12 is not developed. An adhesive can be used for the sealing. A hot melt adhesive or the like may be used as the adhesive. It is desirable that the hot melt adhesive does not become sticky when the mount sheet 12 is developed. For example, a projecting portion slightly higher than the projecting portions 52*a* of the PTP sheet 50 may be provided on the PTP sheet 50, a through hole may be provided at a part of the ejector tool holder 40 which is in contact with that projecting portion, and the hot melt adhesive may be applied to the third surface 36 exposed from that through hole. In this manner, the hot melt adhesive can be applied to a portion recessed from the front surface 12*a* of the ejector tool holder 40 and thus adhesion of the hot melt adhesive to the finger or the like can be prevented. In addition, dust and dirt become difficult to adhere to the hot melt adhesive. When the mount sheet 12 is folded, the projecting portion higher than the projecting portions 52*a* of the PTP sheet 50 is placed in the through hole to achieve reliable adhesion to the hot melt adhesive and the double-folded mount sheet 12 is folded.

Figure 2:
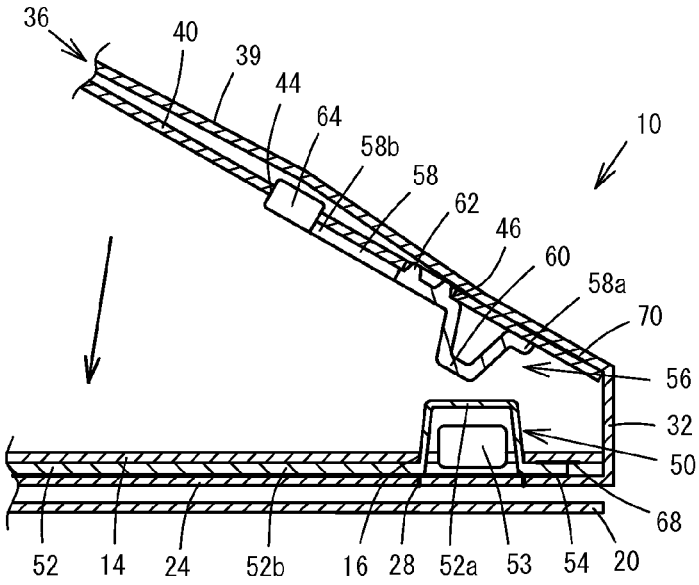
FIG. 2(*a*) is a fragmentary longitudinal sectional view illustrating a state in which the mount sheet of the card package of the present embodiment is opened.
Figure 2:
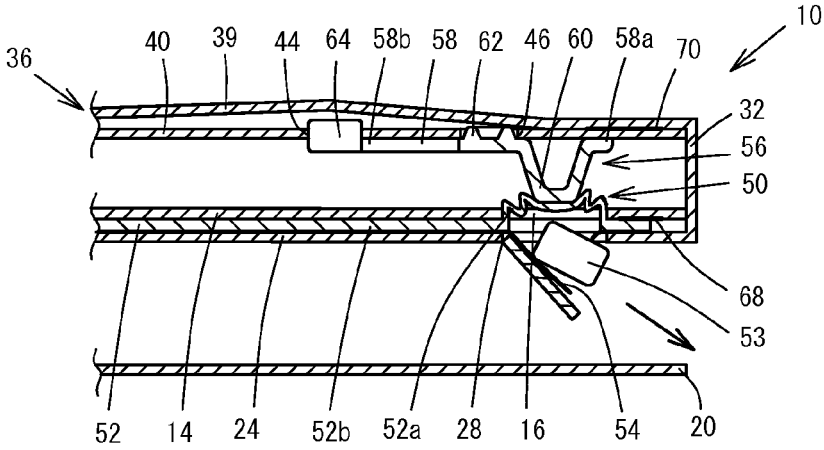

When taking out a first tablet 53 from the card package 10, rotate the ejector tool 56 about the locking projection 64 to the printed portion 48 in which "1" is printed, then place the positioning projection 62 inside the positioning through hole 46 and stop rotation to complete the positioning as illustrated in FIG. 2(*a*). Then the folding lines 34 and 38 are mountain-folded at 90 degrees to fold the mount sheet 12 into two halves about the gore 32 and the halves are pressed against each other as illustrated in FIG. 2(*b*). Then, the pressing projection 60 of the ejector tool 56 presses the projecting portion 52*a* of the PTP sheet 50 which has been place in a hole 16 on the first surface 14, a tablet 53 is pushed out, the sheet 54 of the PTP sheet 50 and the rupturable line 28 in which "1" is printed of the second surface 24 are ruptured and the tablet 53 is taken out. Since the folding-back piece 20 is placed over the second surface 24 at this time, falling of the tablet 53 is prevented. When taking out a tablet 53 for the next taking, rotate the ejector tool 56 to the printed portion 48 in which "2" is printed. Then the folding lines 34 and 38 are mountain-folded at 90 degrees to fold the mount sheet 12 into two halves about the gore 32, and the rupturable line 28 in which "2" is printed of the second surface 24 is ruptured and the tablet 53 is taken out. This procedure is repeated. How many times the tablet 53 has been taken is clear from the number printed on the rupturable lines 28.

According to the card package 10 of the present embodiment, the tablet 53 accommodated therein can be taken out even with small force. The tablet 53 can be pushed out upward or can be pushed out downward. Since the ejector tool 56 is provided integrally, the taking-out operation is easy; the tablet 53 can be taken out by pressing the second surface 24 or the third surface 36 with the palm, elbow, or the like without using the fingertip. Even patients of rheumatism or cerebrovascular disorder and elderly persons can take the tablet 53 out easily. The card package 10 is also useful for ordinary healthy persons. It is also possible to take out the tablet 53 in an existing manner in which the mount sheet 12 is developed and the projecting portion 52*a* of the PTP sheet 50 is pushed with the finger.

With the ejector tool 56, since the positioning projection 62 is placed in the positioning through hole 46 of the printed portion 48 for the positioning, the tablet 53 to be taken out can be selected with the recognition of the number on the printed portion 48 so that the tablet 53 can be taken out properly. Since the tablet 53 is taken out accompanying the rupture of the rupturable line 28 of the second surface 24, the trace of taking the tablet 53 enables administration management. Thus the card package 10 is effective in preventing improper take or use of the tablet 53 by elderly persons and patients with impaired mind and body function or the like, and in increasing the quality of instruction on taking medicine by medical institutions. As described above, with the card package 10, the tablet 53 can be taken out easily and the compliance regarding the medicine with a person can be enhanced by explicitly specifying the administration method, cautions, and records.

Since the flange 66 of the locking projection 64 is reliably locked on the rear surface 12*b* of the ejector tool holder 40, the ejector tool 56 is not inadvertently removed during transportation or the like. At the time of disposal, however, the ejector tool 56 can be removed with an easy operation and can be disposed separately from the mount sheet 12. In addition, in that case, the PTP sheet 50 and the mount sheet 12 can be separately disposed by, for example, tearing the mount sheet 12. If such separate disposal is required, a structure in which the PTP sheet 50 is merely disposed and fixed between the first surface 14 and the second surface 24 or a structure in which the mount sheet 12 includes perforations with which the PTP sheet 50 can be removed from the mount sheet 12 easily when the mount sheet 12 is ruptured along the perforations may be employed.

If the ejector tool 56 is placed at positions in readiness other than the printed portion 48 of the ejector tool holder 40, improper ejection of the tablet 53 can be prevented and, if the ejector tool 56 is removed from the ejector tool holder 40 with an easy operation, inadvertent ejection of the tablet 53 can be prevented. With this, measures to prevent accidental ejection of the tablet 53 and improper taking of the tablet 53 by a child can be taken. The ejection tool 56 can be assembled to the ejector tool holder 40 by hand or machine easily in an assembly process of the card package 10, which contributes increased manufacturing efficiency.

Since the ejector tool 56 is compact and not bulky, the card package 10 can be carried in a compact shape and the tablet can be ejected with an easy operation at any places. Although the ejector tool 56 is compact, the tablet 53 can be pushed out by pressing a position near the center of the third surface 36 or the second surface 24 and thus no fine operation is necessary.

Since the folding-back piece 20 is placed over the rear surface 12*b* of the second surface 24, the trace of the rupture of the rupturable line 28 can be covered with the folding-back piece 20. Thus aesthetic appearance of the card package 10 is enhanced. The folding-back piece 20 prevents tablet 53 popping out and lost, or dropped on the floor when it jumps out of the rupturable line 28 of the second surface 24.

Since the rupturable line 28 is formed by the cut portions and the uncut portions which are arranged alternately, a person who ruptures the uncut portions meets resistance in cutting the uncut portions to take out the tablet 53. The resistance helps prevent jumping of the pushed tablet 53 when pushed upward or downward. With the change in the ratio of the cut portions and the uncut portions of the rupturable line 28, the resistance upon pushing the tablet 53 out is changed and thereby the ease of ejection is controlled. Since the force applied by the ejector tool 56 when taking the tablet 53 out is oriented in one direction, the ease of ejection is controlled most easily when the center of the uncut portion is located at a position corresponding to a radial direction from the center. With the change in the ratio of the uncut portions at predetermined positions, the rupturable line 28 ruptures at position where a smaller amount of the uncut portions exist and the tablet 53 falls on the ruptured side, the direction in which the tablet 53 is taken out can be determined arbitrarily.

The mount sheet 12 has a wide printing space on the folding-back piece 20 and the third surface 36; therefore details about the tablet 53 can be printed on the space to attract consumers' considerable attention. Required information, including usage and dosage, and details of the medicine can be given in a manner to be easily recognizable by the consumers; it is also possible to give the method of pushing the tablet 53 out by easily recognizable illustrations in different colors or the like.

The card package 10 can, with the mount sheet 12 being folded, be put in a bag, sealed with a tape or sealed with an adhesive so as not to develop; in this manner, the mount sheet 12 can be hung for sales in retail stores. Alternatively, the card package 10 can be carried in a pocketable size.

Figure 7:
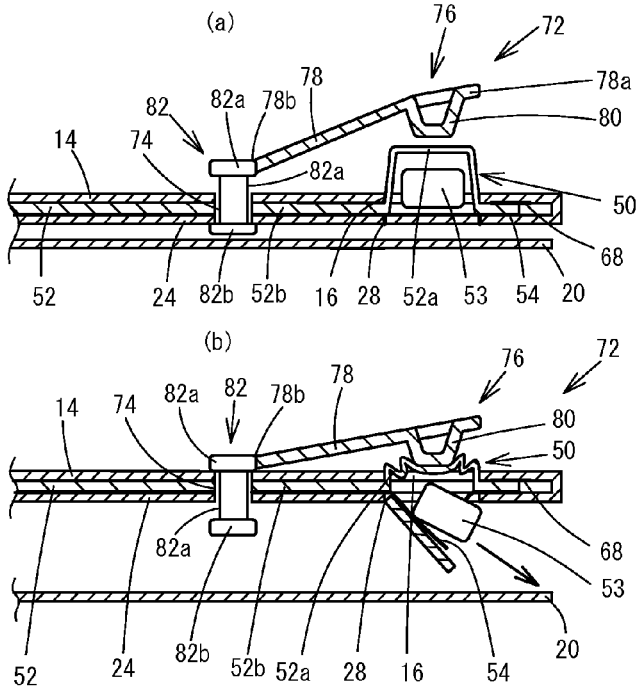
FIG. 7(*a*) is a fragmentary longitudinal sectional view of the card package of another embodiment of the present invention illustrating a state in which a mount sheet is opened.

Next, other embodiments of the card package of the present invention will be described with reference to FIG. 7. Here, the same components as those in the embodiment described above are denoted by the same reference numerals, and description thereof will be omitted. A card package 72 of the present embodiment includes an ejector tool 76 which includes, on a first surface 14, a pressing projection 80 which faces a projecting portion 52*a* of a PTP sheet 50.

The ejector tool 76 is made of synthetic resin, such as PP, in an integrated manner. The ejector tool 76 includes, as illustrated in FIG. 7, a main body 78 which is provided with a conical shaped pressing projection 80 projecting from one side of the main body 78 at a longitudinal end 78*a* of the main body 78. The diameter of a tip part of the pressing projection 80 is smaller than the diameter of projecting portions 52*a* of a molded plastic product 52.

A locking portion 82 is formed in the main body 78 on an end 78*b* which is opposite to the end 78*a*. The locking portion 82 fits in a holding through hole 74 formed to penetrate the centers of a first surface 14, a PTP sheet 50 and a second surface 24. The locking portion 82 includes flanges 82*b* at both ends of a cylindrical portion 82*a* which prevent removal from the holding through hole 74. The length of the cylindrical portion 82*a* is substantially equal to the height of the projecting portions 52*a*. The cylindrical portion 82 can be slid inside the holding through hole 74 when subject to a pressing operation.

According to the card package 72 of the present embodiment, the same effect as that of the embodiment described above is achieved, and the card package 72 can be simple in structure and can be provided in the reduced cost.

The card package of the present invention is not limited to the embodiments described above: the number of accommodated tablets can be suitably changed; and the positions of the projecting portions of the PTP sheet can be changed arbitrarily, e.g., linearly or in multiple parallel lines, in addition to those arranged on the circumference of a virtual circle, or longer than those. For example, in accordance with the arrangement of the projecting portions, the holding portion and the holding through hole for holding the ejector tool may be formed as a slot which is parallel to the sequence of the projecting portions of the PTP sheet, whereby the ejector tool may be slid along the slot. In addition, the positioning projections and recesses may face the projecting portions of the PTP sheet such that the pressing projection of the ejector tool reliably presses the projecting portion. Therefore, the present invention can be applied to existing, common in commercial use, rectangular PTP sheets including, for example, two rows×5 tablets.

Materials of the molded plastic product of the PTP sheet may be selected arbitrarily and may be, for example, aluminum. It is possible that one of the projecting portions of the PTP sheet does not exist at a position which otherwise exists at equal intervals and may be used as a position in readiness of the ejector tool.

The shape, size and color of the ejector tool and the shape, size and color of the projection of the ejector tool can be adjusted depending on, for example, the shape of a tablet, a capsule and the projecting portion of the PTP sheet. The structure in which the ejector tool is locked by the ejector tool holder may be implemented by components other than the locking projection and the flange. It is also possible that the shape of the locking projection of the ejector tool may be changed such that the ejector tool rotates only in one direction and not in the opposite direction. For example, the method may use a mechanism such as a ratchet wheel which rotates at a predetermined angle in only one direction.

The material of the ejector tool is arbitrarily selected as long as those having moderate moldability and elasticity; for example, synthetic resin other than PP, engineering plastic and paper may be used. It is also possible that, after the ejector tool is placed in the ejector tool holder, the ejecting tool may be caulked from above and below the mount sheet and thus cannot be removed without rupturing the mount sheet.

The mount sheet may be formed in any shape other than that in the embodiments described above. The order of connection of the components may be changed arbitrarily. The number of panels may be increased depending on the required amount of items to be displayed. The material of the mount sheet may be selected arbitrarily from, for example, plastic, injection-molded product and metal, in addition to paper. A space of several millimeters or smaller may be provided between the ejector tool holder and the front surface to help easier mounting of the ejector tool when the ejector tool is mounted to the mount sheet. The space is provided by means of embossing or forming folding lines in the vicinity thereof. The shape of the holding through hole of the ejector tool holder may be changed such that the ejector tool can be moved only in one direction. The shape of the rupturable line formed in the second surface may be any shapes other than the circular shape. The third surface may by constituted by only one sheet, not by multiple sheets, and the holding through hole to which the ejector tool is attached may be formed on the sheet. Perforations may be formed around the holding through hole along which the ejector tool is separated from the mount sheet to facilitate separate disposal when the card package is disposed. The product packaged in the PTP sheet is not limited to the medicine but may be other products.

The invention claimed is:

1. A card package, comprising: a PTP sheet and a mount sheet, the PTP sheet including a molded product which has multiple projecting portions accommodating products therein and a flat portion provided in the circumference of the projecting portions, and a rupturable sheet which is affixed to the molded product to seal openings of the projecting portions, the PTP sheet being affixed to the mount sheet, wherein:

the mount sheet includes:

a first surface to be placed on the PTP sheet on a surface on which the projecting portions are projecting;

multiple holes formed in the first surface and in which the projecting portions are placed;

a second surface to be placed on an opposite surface of the PTP sheet;

multiple rupturable portions formed in the second surface at positions corresponding to each of the projections when the second surface is folded and placed on the PTP sheet;

a fixing means which holds the PTP sheet between the first surface and the second surface; and an ejector tool formed on the first surface and has a pressing portion which faces the projecting portions of the PTP sheet.

2. The card package according to claim 1, wherein the pressing portion is a projection projecting toward the projecting portions.

3. The card package according to claim 1, wherein the rupturable line formed in the second surface along circles in the circumference of the projecting portions of the PTP sheet and the rupturable line is by cut portions and uncut portions which are arranged alternately and the uncut portions are ruptured at predetermined positions.

4. The card package according to claim 1, wherein:

the projecting portions of the PTP sheet are arranged along a circumference of a virtual circle;

one end of the ejector tool is rotatably locked by a holding through hole formed in the first surface; and the other end of the ejector tool is formed to correspond to the circumference of the virtual circle along which the projecting portions of the PTP sheet are arranged.

5. The card package according to claim 1, wherein:

a positioning projection is formed in an intermediate portion of the main body of the ejector tool; and when the ejector tool is moved to a predetermined position, the positioning projection is placed in and locked by the positioning through hole formed in the first surface and the pressing portion of the ejector tool faces the projecting portions of the PTP sheet in that state.

6. A card package, comprising: a PTP sheet and a mount sheet, the PTP sheet including a molded product which has multiple projecting portions accommodating products therein and a flat portion provided in the circumference of the projecting portions, and a rupturable sheet which is affixed to the molded product to seal openings of the projecting portions, the PTP sheet being affixed to the mount sheet, wherein:

the mount sheet includes:

a first surface to be placed on the PTP sheet on a surface on which the projecting portions are projecting;

multiple holes formed in the first surface and in which the projecting portions are placed;

a second surface to be placed on an opposite surface of the PTP sheet;

multiple rupturable portions formed in the second surface at positions corresponding to each of the projections when the second surface is folded and placed on the PTP sheet;

a fixing means which holds the PTP sheet between the first surface and the second surface;

a third surface which continues from the first surface or the second surface via a folding line and is to be placed on the PTP sheet on a surface at which the projecting portions are projecting; and an ejector tool affixed to the third surface on a surface to be placed on the first surface, and having a pressing portion which faces the projecting portions of the PTP sheet.

7. The card package according to claim 6, wherein the pressing portion is a projection projecting toward the projecting portions.

8. The card package according to claim 6, wherein the rupturable line formed in the second surface along circles in the circumference of the projecting portions of the PTP sheet and the rupturable line is by cut portions and uncut portions which are arranged alternately and the uncut portions are ruptured at predetermined positions.

9. The card package according to claim 6, wherein:

the third surface is folded to face the first surface;

the third surface is provided with a holding portion which holds the ejector tool to be movable; and the ejector tool is provided with a locking portion which is locked by the holding portion to be movable.

10. The card package according to claim 9, wherein:

the third surface is provided with a positioning through hole in which a part of the ejector tool is placed and positioned; and the ejector tool is provided with a positioning projection placed in the positioning through hole.

11. The card package according to claim 9, wherein:

the projecting portions of the PTP sheet are arranged along a circumference of a virtual circle;

the third surface is provided with a holding through hole which holds the ejector tool to be rotatable;

the ejector tool is provided with a locking projection which is locked by the holding through hole to be rotatable;

the locking projection of the ejector tool is locked by the holding through hole to be rotatable; and the pressing portion of the ejector tool is formed to be located on the circumference of the virtual circle along which the projecting portions of the PTP sheet are arranged.

12. The card package according to claim 11, wherein:

the positioning projection is formed in an intermediate portion of the main body of the ejector tool;

when the ejector tool is rotated by a predetermined angle, the positioning projection is placed in and locked by the positioning through hole formed in the third surface; and the pressing portion of the ejector tool faces the projecting portions of the PTP sheet in that state.

* * * * *